US011186459B2

(12) United States Patent
Yamada et al.

(10) Patent No.: US 11,186,459 B2
(45) Date of Patent: Nov. 30, 2021

(54) MEDIUM CUTTING DEVICE AND IMAGE FORMATION APPARATUS

(71) Applicant: Oki Data Corporation, Tokyo (JP)

(72) Inventors: Takuya Yamada, Tokyo (JP); Naoki Kanzawa, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 3 days.

(21) Appl. No.: 16/742,701

(22) Filed: Jan. 14, 2020

(65) Prior Publication Data

US 2020/0270091 A1 Aug. 27, 2020

(30) Foreign Application Priority Data

Feb. 26, 2019 (JP) ..... JP2019-033127

(51) Int. Cl.
*B65H 35/06* (2006.01)
*B65H 16/02* (2006.01)
*G03G 15/00* (2006.01)

(52) U.S. Cl.
CPC ..... *B65H 35/06* (2013.01); *B65H 16/02* (2013.01); *G03G 15/6523* (2013.01)

(58) Field of Classification Search
CPC ..... G03G 15/6523; B65H 2301/515323
See application file for complete search history.

(56) References Cited

U.S. PATENT DOCUMENTS 3,075,493 A * 1/1963 Lewis ..... B26D 5/32 118/699
3,289,532 A * 12/1966 Baumbarten et al. ..... G03G 15/6523 355/28
3,834,963 A * 9/1974 Hoffman ..... B65C 9/1819 156/215
2011/0107885 A1* 5/2011 Nihashi ..... B26D 1/385 83/13

FOREIGN PATENT DOCUMENTS

DE 2542383 A * 4/1976 ..... B65C 9/1819
JP 60049350 A * 3/1985 ..... G03G 15/6523
JP 2010-76090 A 4/2010

* cited by examiner

*Primary Examiner* — Jennifer Bahls
(74) *Attorney, Agent, or Firm* — Metrolex IP Law Group, PLLC

(57) ABSTRACT

A medium cutting device according to an embodiment may include: a fixed blade provided on one side with respect to a conveyance path in which a medium is conveyed in a thickness direction of the medium orthogonal to a surface of the medium and including a cutting edge thereof; a rotary blade provided on the other side with respect to the conveyance path in the thickness direction, and including a cutting edge thereof, wherein the rotary blade is configured to be rotated in a rotation direction so that the cutting edge of the rotary blade passes by the cutting edge of the fixed blade to cut at a cutting position the medium being conveyed; and a guide member provided upstream of the cutting position in a conveyance direction of the medium and configured to bias the medium toward the rotary blade side.

14 Claims, 8 Drawing Sheets

MEDIUM CUTTING DEVICE AND IMAGE FORMATION APPARATUS

CROSS REFERENCE TO RELATED APPLICATIONS

This application claims priority based on 35 USC 119 from prior Japanese Patent Application No. 2019-033127 filed on Feb. 26, 2019, entitled "MEDIUM CUTTING DEVICE AND IMAGE FORMATION APPARATUS", the entire contents of which are incorporated herein by reference.

BACKGROUND

The disclosure may relate to a medium cutting device and an image formation apparatus, and, for example, may be applicable to an electrophotographic image formation apparatus such as an electrophotographic printer, copying machine, or the like.

In a related art, there is a medium cutting device that includes: a fixed blade located above a conveyance path along which a long continuous sheet is conveyed; and a rotary blade located below the conveyance path and configured to be driven to rotate. The medium cutting device drives the rotary blade to pass a cutting edge of the rotary blade by a cutting edge of the fixed blade while conveying the sheet, to thereby cut the sheet (for example, see Patent Document 1).

Patent Document 1: Japanese Patent Application Publication No. 2010-76090

SUMMARY

In such a medium cutting device, there is a possibility of jamming of the sheet in the device.

An object of an aspect of one or more embodiments may be to provide a medium cutting device and an image formation apparatus capable of preventing a medium from traveling in an unintended direction after cutting the medium so as to stably convey the medium.

An aspect of one or more embodiments may be a medium cutting device that includes: a fixed blade provided on one side with respect to a conveyance path in which a medium is conveyed in a thickness direction of the medium orthogonal to a surface of the medium and including a cutting edge thereof; and a rotary blade provided on the other side with respect to the conveyance path in the thickness direction, and including a cutting edge thereof, wherein the rotary blade is configured to be rotated in a rotational direction so that the cutting edge of the rotary blade passes through the cutting edge of the fixed blade to cut the medium being conveyed. The medium cutting device further includes a guide member provided upstream of the cutting position in a conveyance direction of the medium and configured to bias the medium toward the rotary blade.

Another aspect of one or more embodiments may be an image formation apparatus including the above medium cutting device.

According to the above aspects, after the medium is cut at a cutting position, a catted edge of the medium, which is, a leading end of the medium in the conveyance direction can be moved toward the fixed blade due to a restoring force of the medium to resolve the deflection of the medium deflected toward the rotary blade.

Therefore, the aspects may realize a medium cutting device and an image formation apparatus that can stably convey the medium after cutting the medium using the restoring force of the medium.

DETAILED DESCRIPTION

Figure 1:
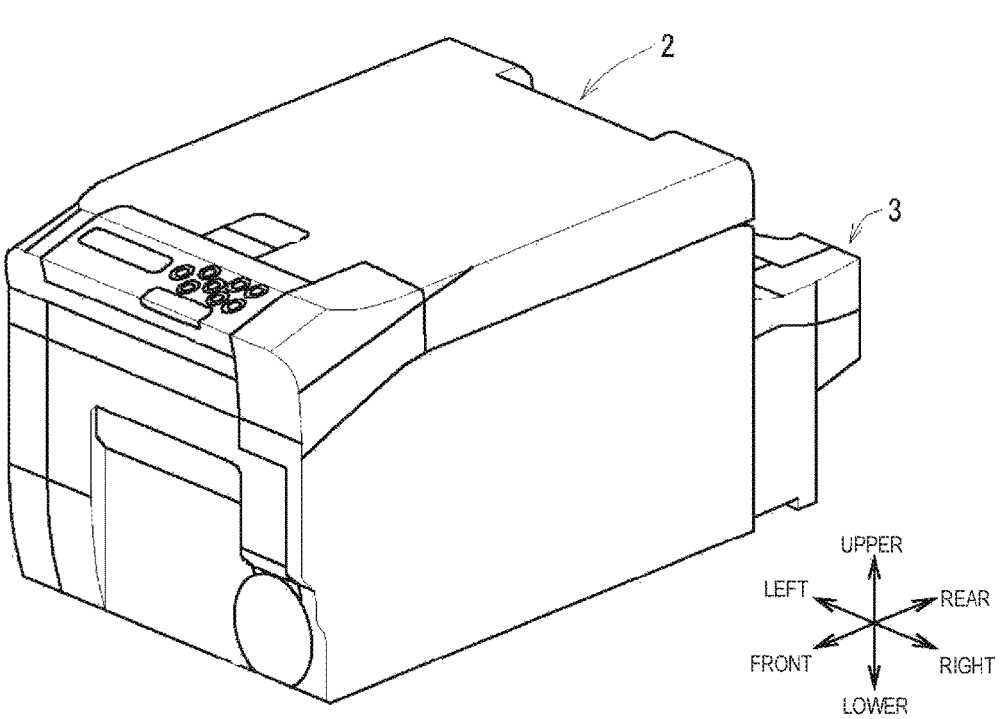
FIG. 1 is a diagram illustrating a perspective view of an external configuration of an image formation apparatus according to one or more embodiments.

Descriptions are provided hereinbelow for embodiments based on the drawings. In the respective drawings referenced herein, the same constituents are designated by the same reference numerals and duplicate explanation concerning the same constituents is omitted. All of the drawings are provided to illustrate the respective examples only.

1. Configuration of Image Formation Apparatus

Figure 2:
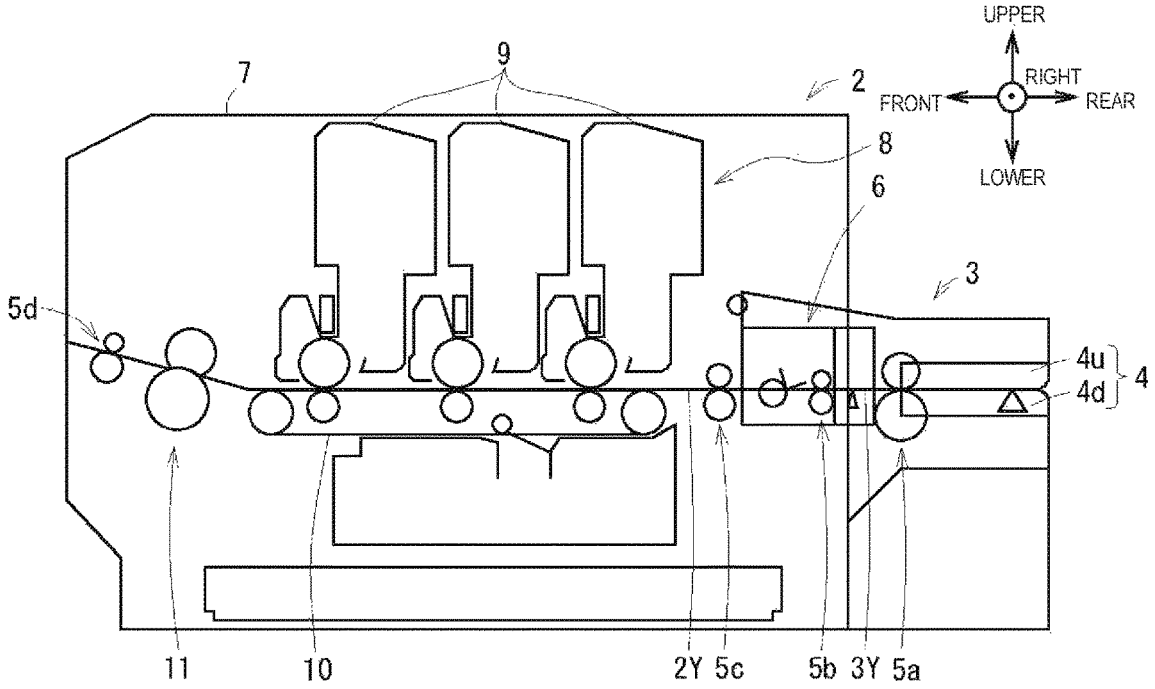
FIG. 2 is a diagram illustrating a right side view of an internal configuration of the image formation apparatus according to one or more embodiments.

As illustrated in FIGS. 1 and 2, an image formation apparatus 1 is configured as an electrophotographic printer, to print a desired color image on a medium, for example, a long continuous sheet. The image formation apparatus 1 includes a main body unit 2 that performs a printing processing, a conveyance cutting unit 3 that is provided on a rear side of the main body unit 2 and conveys and cuts the sheet, and a roll feeder unit (not illustrated) that is provided on the rear side of the conveyance cutting unit 3 and configured to feed the sheet. For convenience of explanation, the main body unit 2 side may be referred to as a front direction, the conveyance cutting unit 3 side may be referred to as a rear direction, a front side of the page of FIG. 2 may be referred to as a right direction, a back side of the page of FIG. 2 may be referred to as a left direction, an upper side of the apparatus may be referred to as an upper direction, and a lower side of the apparatus may be referred to as a lower direction. The long continuous sheet is wound in a roll shape by being rolled around an outer peripheral surface of a core member (not illustrated) extending along the left-right direction, and one of the longitudinal ends of the sheet is peeled off from the outermost periphery thereof and is to be conveyed to a conveyance path 3*y* and 2Y during printing.

The conveyance cutting unit 3 includes a conveyance path 3*y* therein extending in a front-rear direction. The conveyance cutting unit 3 includes a sheet guide 4, a conveyance roller pair 5*a*, and a sheet cutting unit 6, serving as a medium cutting device, which are sequentially arranged from the back side to the front side along the conveyance path 3Y in the conveyance cutting unit 3. The sheet guide 4 includes an upper sheet guide 4*u* formed with a guide surface that guides an upper surface of the sheet being conveyed on the conveyance path 3Y, and a lower sheet guide 4*d* formed with a guide surface that guides a lower surface of the sheet being conveyed on the conveyance path 3Y. Each of the conveyance roller pair 5*a* and a conveyance roller pair 5*b* includes two conveyance rollers arranged so as to sandwich the conveyance path 3Y from above and below. By rotating the conveyance rollers of the conveyance roller pairs 5*a* and 5*b*, the sheet is conveyed in the front direction as a conveyance direction. Hereinafter, the left-right direction which is orthogonal to the thickness direction of the sheet and orthogonal to the conveyance direction may be referred to as a conveyance width direction.

The sheet cutting unit 6 is a rotary cutter unit that includes a fixed blade and a rotary blade, and configured to cut the sheet while conveying the sheet. Specifically, the sheet cutting unit 6 includes therein the fixed blade and the rotary blade for cutting the sheet, and the conveyance roller pair 5*b* for conveying the sheet, and the like. The sheet cutting unit 6 cuts the sheet for each predetermined sheet length along the conveyance direction, conveys the sheet along the conveyance path 3Y by the conveyance roller pair 5*b*, to feed the sheet into the main body unit 2 provided on the front side of the sheet cutting unit 6, so as to deliver the sheet to the conveyance roller pair 5*c* in the main body unit 2.

The main body unit 2 includes therein the conveyance path 2Y extending in the front-rear direction. The conveyance roller pair 5*c* includes two conveyance rollers arranged so as to sandwich the conveyance path 2Y from above and below. The conveyance roller pair 5*c* conveys the sheet forward along the conveyance path 2Y by rotating the conveyance rollers thereof. The main body unit 2 is provided with an image formation section 8 at an upper portion in a main body housing 7 formed in a rectangular parallelepiped shape. In the image formation section 8, three process units 9 are arranged and aligned in the front-rear direction. Each process unit 9 forms a toner image of a predetermined color in response to the control of a control unit (not illustrated), and transfers the toner image onto the sheet being conveyed by a transfer belt 10. The transfer belt 10 is wound around a plurality of belt rollers. The transfer belt 10 is driven to run by one or more of the plurality of belt rollers, to convey the sheet forward along the conveyance path 2Y to feed the sheet to the fixing device 11.

The fixing device 11 includes fixing rollers disposed on the lower side and the upper side of the conveyance path 2Y, respectively. The fixing device 11 applies heat and pressure to the sheet by heating and rotating the fixing rollers, to fix the toner image on the sheet so as to print an image on the sheet. The fixing device 11 conveys the printed sheet toward a conveyance roller pair 5*d* provided on the front side of the fixing device 11. The conveyance roller pair 5*d* includes two conveyance rollers arranged so as to sandwich the conveyance path 2Y from above and below. The conveyance roller pair 5*d* conveys the printed sheet forward along the conveyance path 2Y by rotating the conveyance rollers thereof, to discharge the printed sheet through a discharge port to the outside of the main body unit 2.

2. Configuration of Sheet Cutting Unit

Figure 3:
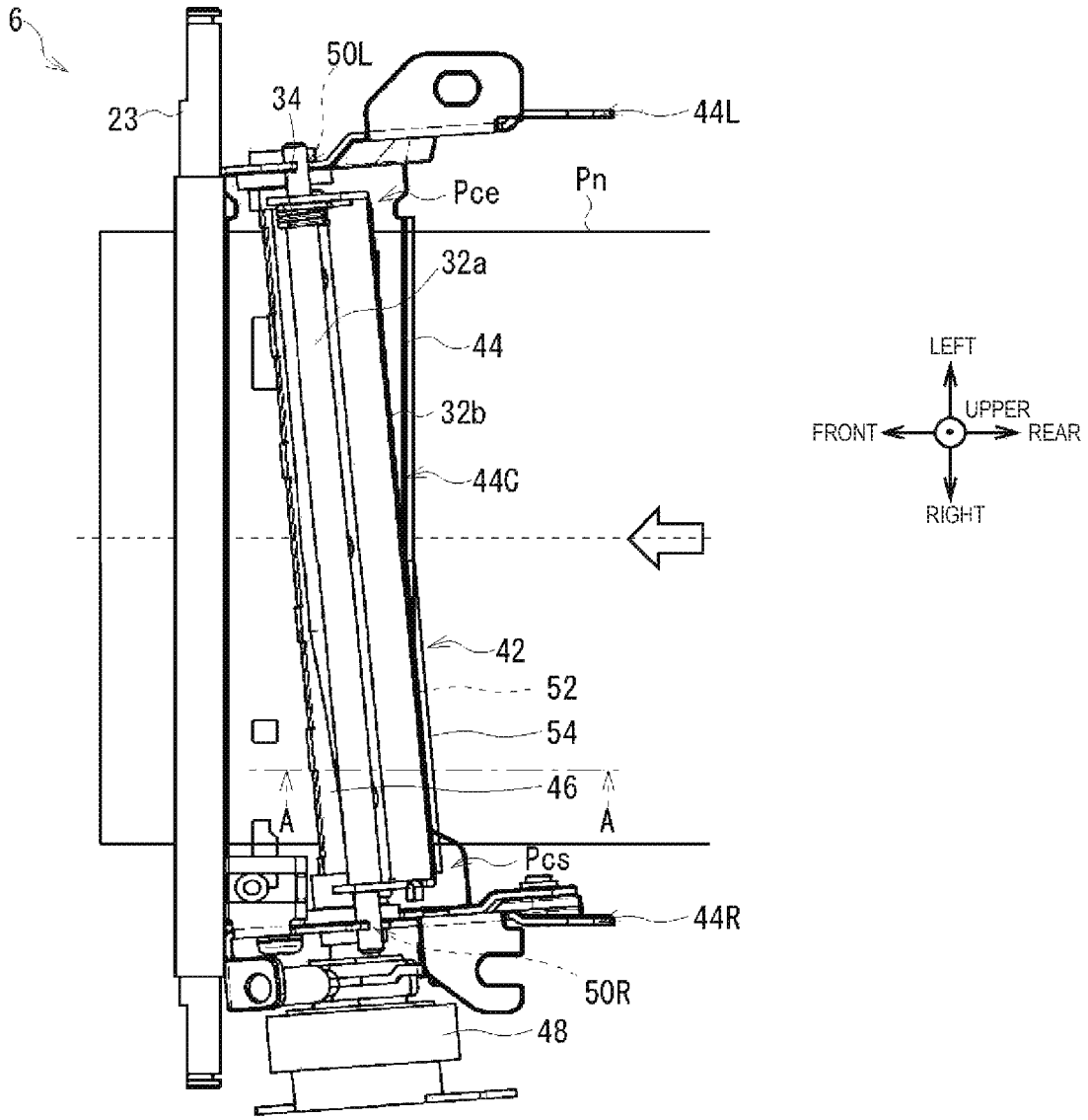
FIG. 3 is a diagram illustrating a plan view of configurations of a fixed blade unit and a rotary blade unit in a cover closed state according to one or more embodiments.
Figure 4:
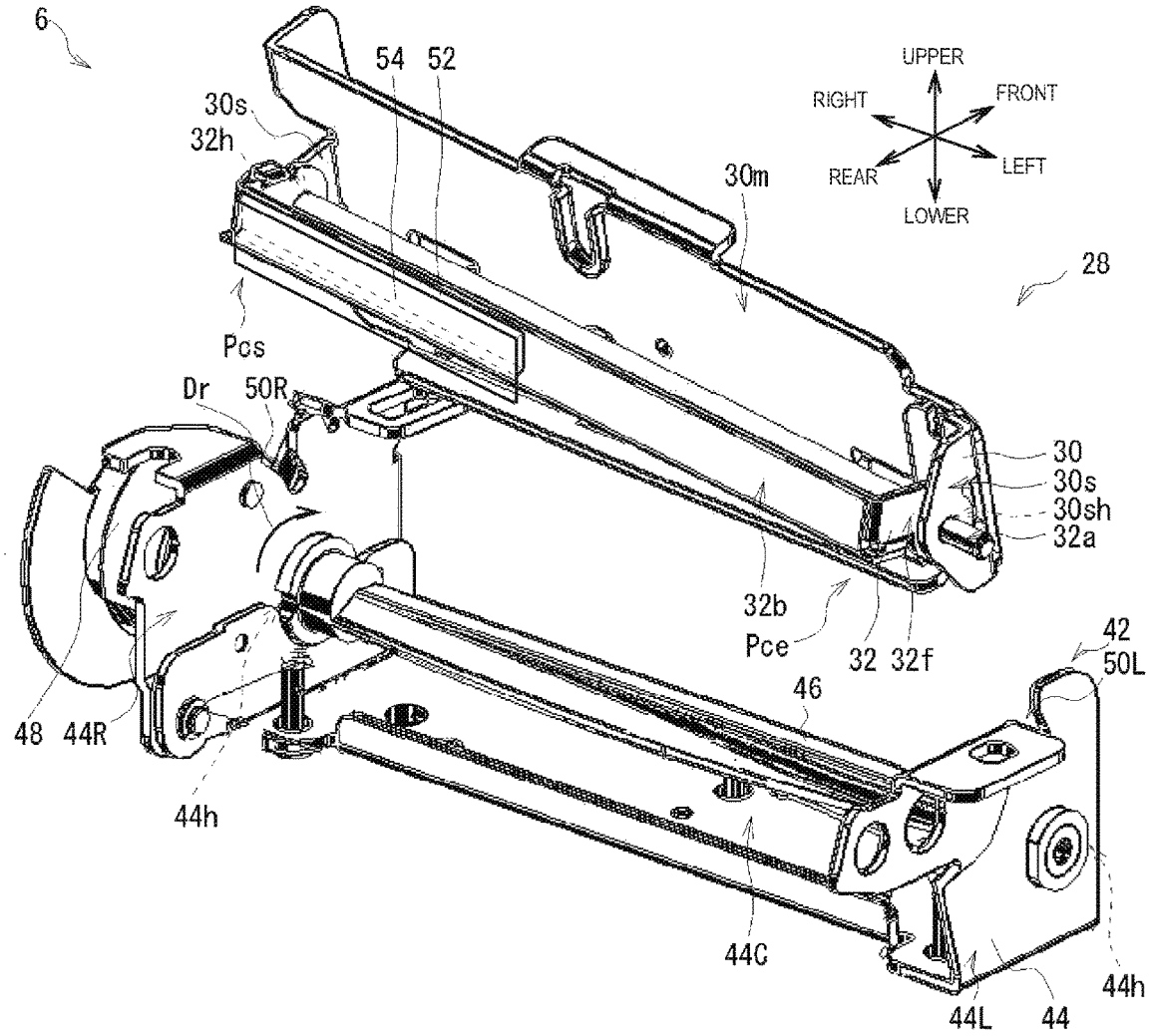
FIG. 4 is a diagram illustrating a perspective view (1) of a configuration of the fixed blade unit and the rotary blade unit in a cover opened state according to one or more embodiments.
Figure 5:
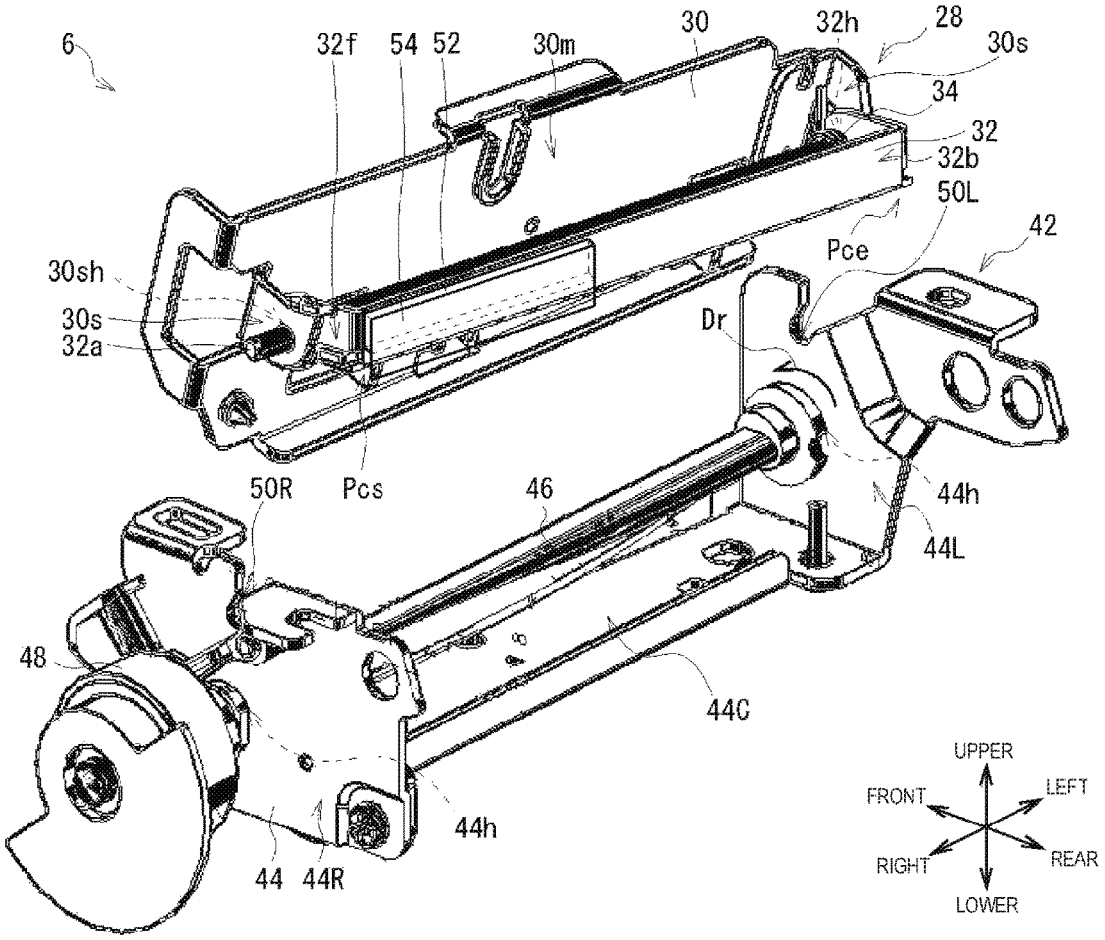
FIG. 5 is a diagram illustrating a perspective view (2) of the configuration of the fixed blade unit and the rotary blade unit in the cover opened state according to one or more embodiments.

As illustrated in FIGS. 4 and 5, the sheet cutting unit 6 mainly includes a fixed blade unit 28 and a rotary blade unit 42. The fixed blade unit 28 is disposed mostly on the upper side with respect to the conveyance path 3Y (FIG. 2), and the rotary blade unit 42 is disposed mainly on the lower side with respect to the conveyance path 3Y (FIG. 2). The fixed blade unit 28 is rotatable (openable) with respect to the rotary blade unit 42 about a shaft 23 illustrated in FIG. 3 as a fulcrum, so as to transition between a cover opened state illustrated in FIGS. 4 and 5 and a cover closed state illustrated in FIG. 3.

When the sheet cutting unit 6 performs the cutting operation and the main body unit 2 performs the printing operation, the sheet cutting unit 6 is in the cover closed state in which the fixed blade unit 28 is rotated to be pushed down about the shaft 23 (FIG. 3) as the fulcrum, so as not to expose the conveyance path 3Y to the outside to protect the inside of the sheet cutting unit 6. To the contrary, when maintenance work is performed, for example, the jammed sheet is removed for the sheet cutting unit 6 by an user, the sheet cutting unit 6 is in the cover opened state in which the fixed blade unit 28 is rotated to be lifted up about the shaft 23 (FIG. 3) as the fulcrum, to expose the conveyance path 3Y to the outside, so that the maintenance work in the sheet cutting unit can be easily performed.

3. Configuration of Rotary Blade Unit

Figure 6:
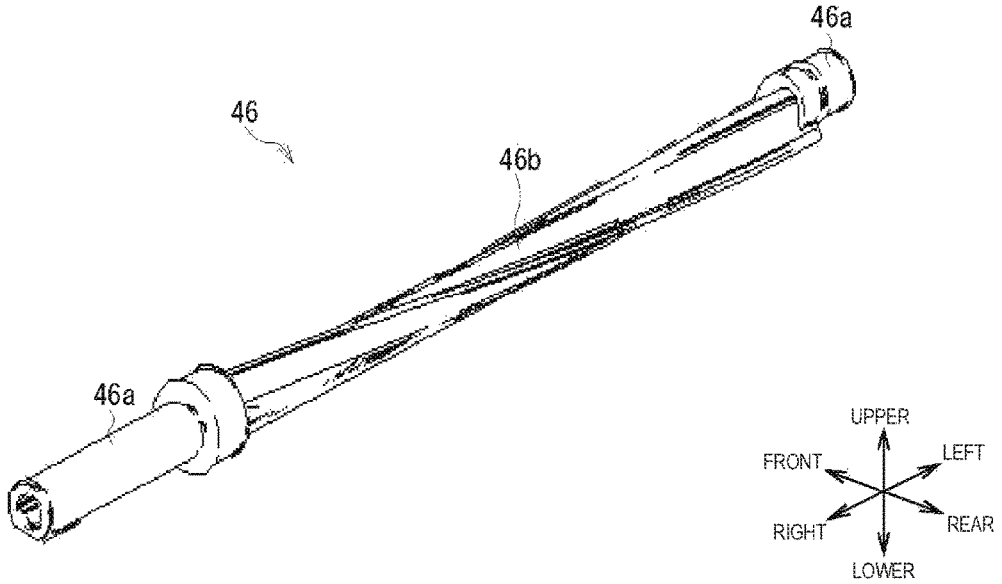
FIG. 6 is a diagram illustrating a perspective view of a configuration of a rotary blade part according to one or more embodiments.

As illustrated in FIGS. 3, 4 and 5, the rotary blade unit 42 includes a rotary blade bracket 44 and a rotary blade part 46. The rotary blade bracket 44 is formed of a metal plate and has a U-shape opened upward in the front view, and includes a rotary blade shaft support portion 44R, a rotary blade shaft support portion 44L, and a left-right extending portion 44C. The rotary blade shaft support portion 44R is a plate-like member extending in a plane parallel to the front-rear direction and the vertical direction and provided on the outer side in the right direction than a later-described fixed blade 32*b*. The rotary blade shaft support portion 44R includes a rotary blade shaft support hole 44*h*, in which a rotary blade shaft 46*a* of the rotary blade part 46 illustrated in FIG. 6 is rotatably fitted. The rotary blade shaft support portion 44L is a plate-like member extends in a plane parallel to the front-rear direction and the vertical direction and provided on the outer side in the left direction than the fixed blade 32*b*. The rotary blade shaft support portion 44L is opposed to the rotary blade shaft support portion 44R in the left-right direction. The rotary blade shaft support portion 44L includes a rotary blade shaft support hole 44*h*, in which the rotary blade shaft 46*a* of the rotary blade part 46 is rotatably fitted. The left-right extending portion 44C extends in the left-right direction and is connected to the rotary blade shaft support portion 44R and the rotary blade shaft support portion 44L.

The rotary blade part 46 (FIGS. 6 and 7) includes the rotary blade shaft 46*a* and a rotary blade 46*b*. The rotary blade shaft 46*a* has a substantially cylindrical shape extending along the left-right direction. The rotary blade shaft 46*a* is rotatably fitted in the rotary blade shaft support holes 44*h* of the rotary blade shaft support portion 44R and the rotary blade shaft support portion 44L, so as to be rotatable in a rotation direction Dr which is the counterclockwise direction in FIG. 8. The rotary blade 46*b* is provided at a portion of the rotary blade shaft 46*a* between the rotary blade shaft support portion 44R and the rotary blade shaft support portion 44L. The rotary blade 46*b* includes a cutting edge formed in a spiral shape along the conveyance width direction. The rotary blade 46*b* cuts the sheet when being rotated by the driving force transmitted through a cutter drive gear(s) 48.

The rotary blade shaft support portion 44R and the rotary blade shaft support portion 44L are respectively formed with a fitting groove 50R and a fitting groove 50L that open upward in the side view, so that the fixed blade shaft 32*a* is to be fitted in the fitting grooves 50R and 50L.

Figure 7:
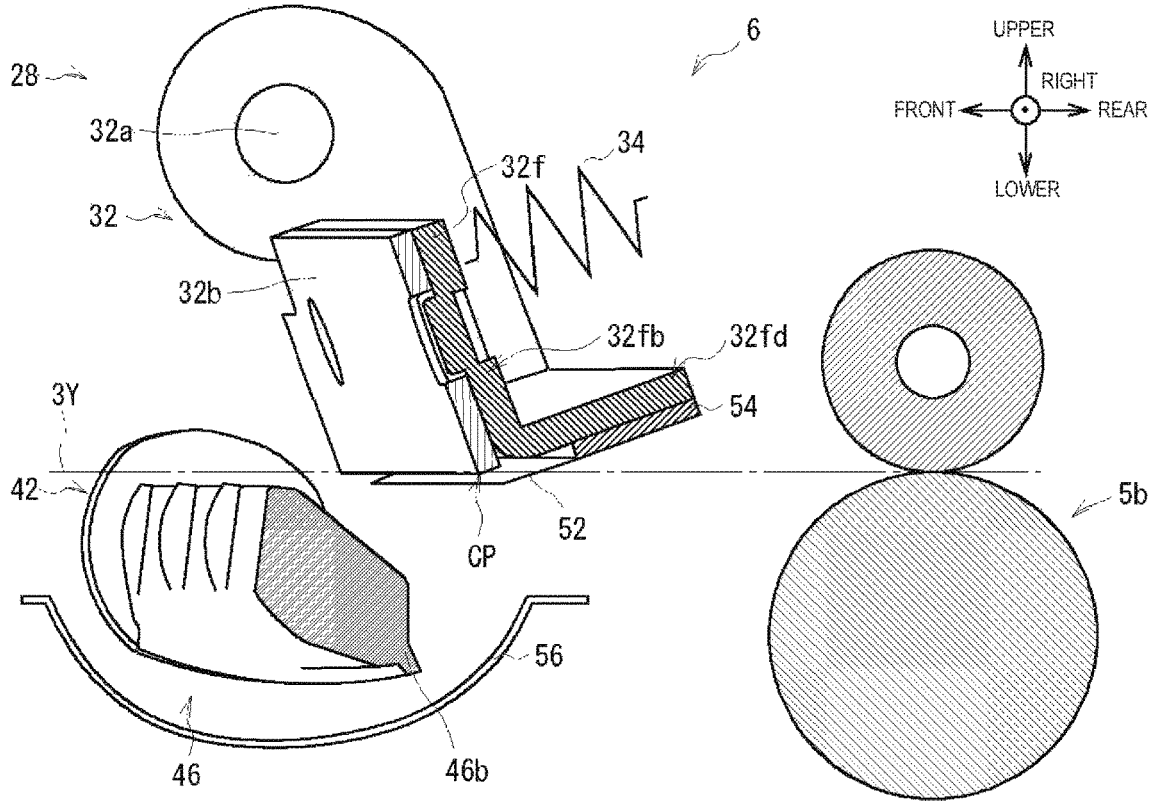
FIG. 7 is a diagram illustrating a cross-sectional view taken along the line A-A in FIG. 3, illustrating a configuration of a sheet cutting unit according to one or more embodiments.

A guide 56 is provided out of and along a rotational trajectory of the cutting edge of the rotary blade 46*b*, surrounding the front side, the lower side, and the rear side of the rotary blade 46*b* (see FIG. 7). The guide 56 faces upward and may guide the lower surface of the sheet being conveyed.

4. Configuration of Fixed Blade Unit

As illustrated in FIGS. 4 and 5, the fixed blade unit 28 includes a fixed blade metal plate 30 and a fixed blade part 32. The fixed blade metal plate 30 includes a fixed blade metal plate main body 30*m* and a fixed blade shaft support part 30*s*. The fixed blade metal plate main body 30*m* is a plate-shaped metal plate extending in the left-right direction. The fixed blade shaft support part 30*s* is erected from both ends in the left-right direction of the fixed blade metal plate main body 30*m*. The fixed blade shaft support part 30*s* includes a fixed blade shaft support hole 30*sh*, in which the fixed blade shaft 32*a* of the fixed blade part 32 is fitted.

The fixed blade part 32 includes a fixed blade part frame 32*f*, a fixed blade 32*b*, and a fixed blade shaft 32*a*. The fixed blade part frame 32*f* is a metal plate extending in the left-right direction and includes at each of the left and right ends thereof a fixed blade shaft hole 32*h* in which the fixed blade shaft 32*a* is inserted. The fixed blade part frame 32*f* includes a lower end portion formed in a L-shape in the cross section. A front end portion of the fixed blade part frame 32*f* is referred to as a frame front end portion 32*fb* and the lower end portion of the fixed blade part frame 32*f* is referred to as a frame lower end portion 32*fd*. The fixed blade 32*b* is made of metal, extends along the conveyance width direction, and is fixed to the frame front end portion 32*fb* of the fixed blade part frame 32*f*. The fixed blade 32*b* has a cutting position CP, which is a lower end thereof to be in contact with the rotary blade 46*b*, on the conveyance path 3Y. As illustrated in FIG. 3, the fixed blade shaft 32*a* has a cylindrical shape extending in a tilted manner with respect to the left-right direction, such that the right end of the fixed blade shaft 32*a* is located closer to the rear side than the left end of the fixed blade shaft 32*a* (that is, the right end of the fixed blade shaft 32*a* is located closer to the upstream side than the left end of the fixed blade shaft 32*a* in the conveyance direction). The fixed blade shaft 32*a* is inserted in the fixed blade shaft holes 32*h* of the blade part frame 32*f* (FIGS. 4, 5, and 7). With this, the fixed blade shaft 32*a* is inclined with respect to the shaft 23 (FIG. 3). The fixed blade part 32 is rotatably supported by the fixed blade metal plate 30 in such a manner that the fixed blade shaft 32*a* is rotatably fitted in the fixed blade shaft support hole 30*sh* of the fixed blade metal plate 30. As described above, the fixed blade 32*b* is fixed to the fixed blade part frame 32*f* and the fixed blade part frame 32*f* supports the fixed blade shaft 32*a*, so that the fixed blade 32*b* moves together with the fixed blade shaft 32*a*. A spring 34 (FIGS. 3, 5 and 7) is wound around the fixed blade shaft 32*a*. The spring 34 biases the fixed blade 32*b* of the fixed blade part 32 toward the rotary blade 46*b* of the rotary blade part 46 with a predetermined bias force, so as to press the fixed blade 32*b* against the rotary blade 46*b*. Because the fixed blade 32*b* is swingably supported with respect to the fixed blade metal plate 30, and is biased toward the rotary blade 46*b* as described above, the load at the time of cutting the sheet is constant, so as to extend the life of the blades 32*b* and 46*b*.

Figure 9:
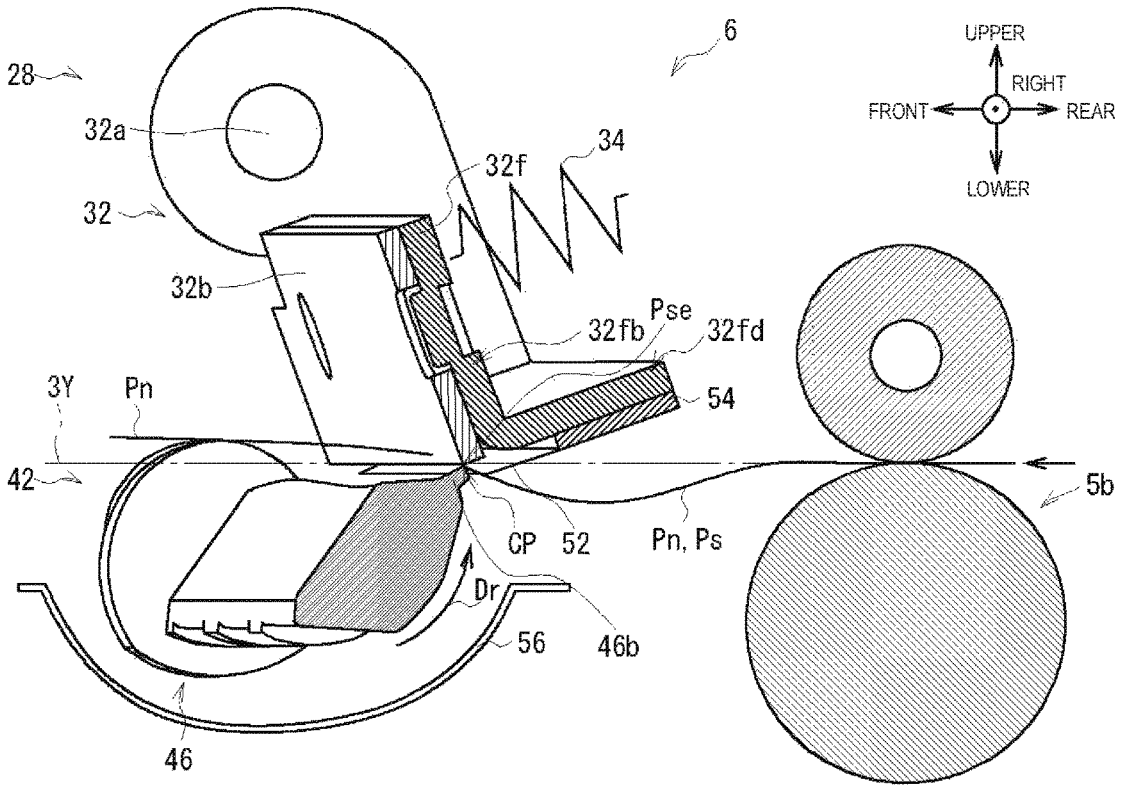
FIG. 9 is a diagram illustrating a cross-sectional view taken along the line A-A in FIG. 3, illustrating a state (2) in which the thin sheet is being conveyed according to one or more embodiments.

In the cover closed state, the sheet cutting unit 6 drives the rotary blade 46*b* to rotate, while conveying the sheet by the conveyance roller pair 5*b*. With this operation, the cutting of the sheet is started from the cutting start position Pcs on the right end of the sheet, and the cutting of the sheet is ended at the cutting end position Pce on the left end of the sheet. In this way, the sheet cutting unit 6 cuts the sheet along the conveyance width direction from the cutting start position Pcs on the right side of the sheet toward the cutting end position Pce on the left side of the sheet. Hereinafter, a portion of the sheet P that is cut at the cutting position CP and located on the upstream side from the cutting position CP in the conveyance direction may be referred to as a next sheet Ps (FIG. 9), and a downstream end (a leading end) of the next sheet Ps in the conveyance direction may be referred to as a next sheet leading end Pse or a leading end Pse (FIG. 9).

5. Configuration of Guide Member

As illustrated in FIGS. 3, 4, 5, and 7, the guide member 52 is fixed with an adhesive member 54 to a lower surface of the frame lower end portion 32*fd* of the fixed blade part frame 32*f* on a side of the cutting start position Pcs.

The adhesive member 54 is a double-sided adhesive tape in an embodiment. The adhesive member 54 is bonded to the lower surface of the frame lower end portion 32*fd*, at an end thereof on a side of the cutting start position Pcs in the conveyance widthwise direction and on an upstream side in the conveyance direction. The adhesive member 54 has a length, in the front-rear direction, of approximately the half of a length of the frame lower end portion 32*fd* in the front-rear direction and a length, in the left-right direction, of slightly less than the half of a length of the frame lower end portion 32*fd* in the left-right direction, for example, about 40 to 45 [%] of the length of the frame lower end portion 32*fd* in the left-right direction.

The guide member 52 is a thin film having elastically deformable and flexible characteristic. The guide member 52 is bonded to the lower surface of the frame lower end portion 32*fd* at the end thereof on the side of the cutting start position Pcs and on the upstream side in the conveyance direction. The guide member 52 has a length in the front-rear direction larger than the length of the frame lower end portion 32*fd* in the front-rear direction and a length in the left-right direction approximately same as the length of the adhesive member 54 in the left-right direction and slightly less than the half of the length of the frame lower end portion 32*fd* in the left-right direction, for example, about 40 to 45 [%] of the length of the frame lower end portion 32*fd* in the left-right direction. The lower end portion of the guide member 52 is projected downwardly beyond the lower end portion of the fixed blade 32*b*. That is, the lower end portion of the guide member 52 is projected beyond the conveyance path 3Y toward the rotary blade 46*b* side. The guide member 52 continuously extends along the conveyance width direction covering all the positions corresponding to the cutting start position Pcs side ends of all types of the sheets having different widths in the conveyance width direction, which are handled in the image formation apparatus 1.

Since the guide member 52 is fixed to the fixed blade part frame 32*f*, the guide member 52 is moved together with the fixed blade part 32.

6. Sheet Cutting Operation

Figure 8:
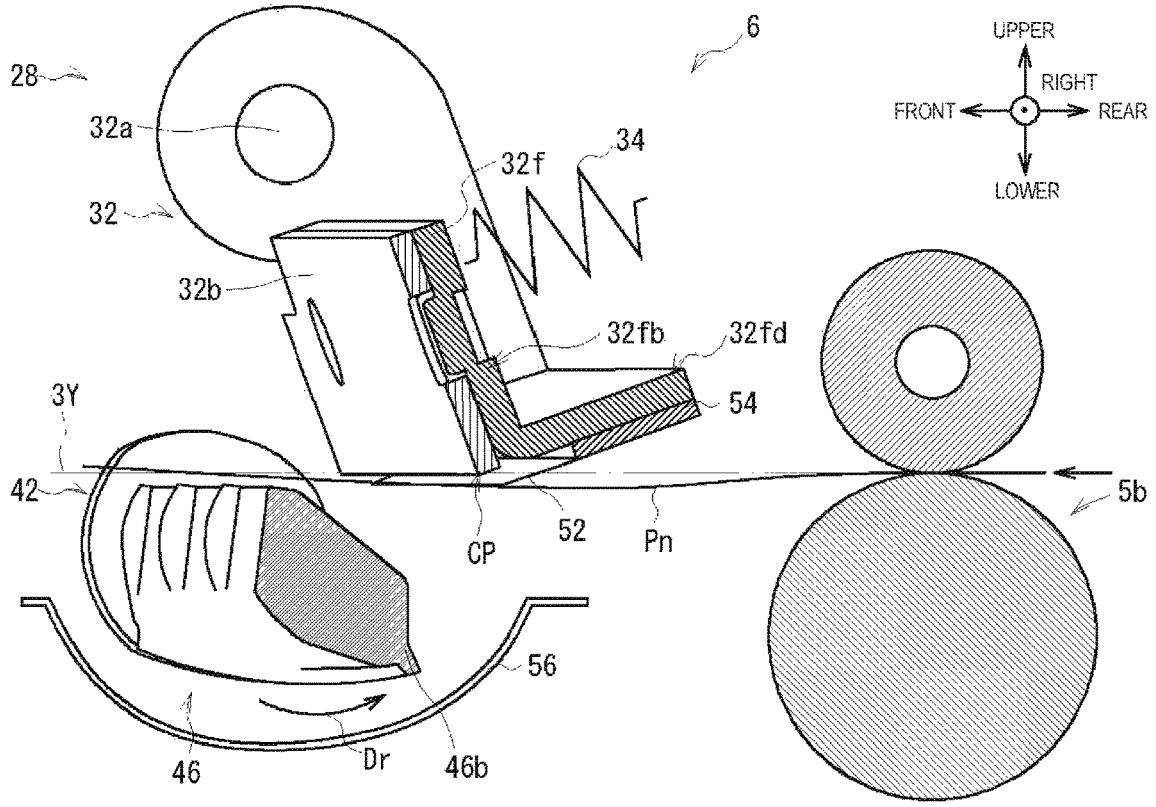
FIG. 8 is a diagram illustrating a cross-sectional view taken along the line A-A in FIG. 3, illustrating a state (1) in which a thin sheet is being conveyed according to one or more embodiments.

According to the above described configuration, upon cutting a thin sheet Pn whose thickness is thin, the sheet cutting unit 6 conveys the sheet Pn by the conveyance roller pair 5*b* as illustrated in FIG. 8. During the sheet conveyance, the sheet cutting unit 6 makes, the lower end portion of the guide member 52 comes in contact with the thin sheet Pn, to bias the thin sheet Pn toward the rotary blade 46*b* side beneath the conveyance path 3Y so as to deflect a part of the thin sheet Pn upstream of the cutting position CP in the conveyance direction (on a rear side) toward the rotary blade 46*b* side to be downwardly curved.

Then, as illustrated in FIG. 9, the sheet cutting unit 6 drives the rotary blade 46*b* to rotate to pass the cutting edge of the rotary blade 46*b* by the cutting edge of the fixed blade 32*b* at the cutting position CP, so as to cut the thin sheet Pn. When cutting the thin sheet Pn, the sheet cutting unit 6 temporarily sandwiches the leading end Pse of the next sheet Ps between the cutting edge of the rotary blade 46*b* and the cutting edge of the fixed blade 32*b*, to temporally block the movement of the leading end Pse of the next sheet Ps by the thickness of the cutting edge of the rotary blade 46*b*. During the time when the thin sheet Pn is temporarily blocked, the sheet Pn keeps to be conveyed in the conveyance direction by the conveyance roller pair 5*b*. Thus, the part of the sheet Pn upstream of the cutting position CP in the conveyance direction is largely deflected and curved toward the rotary blade 46*b* side.

Figure 10:
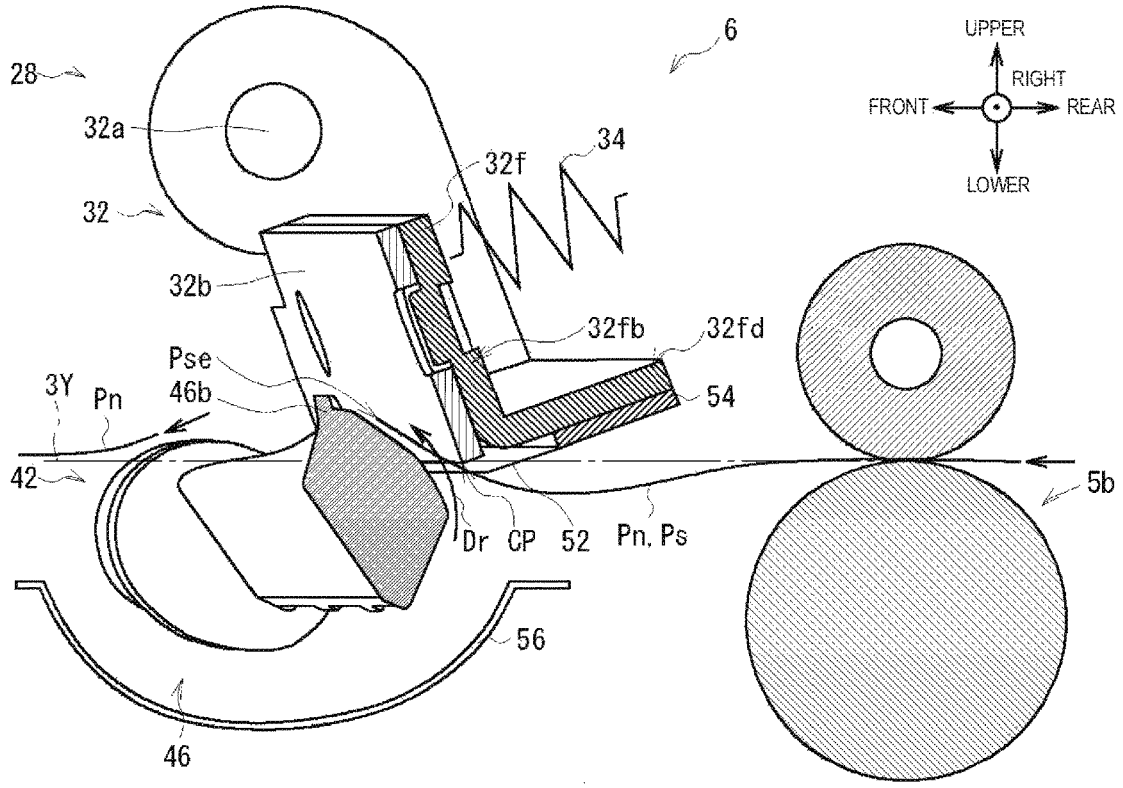
FIG. 10 is a diagram illustrating a cross-sectional view taken along line A-A in FIG. 3, illustrating a state (3) in which the thin sheet is being conveyed according to one or more embodiments.

When the cutting of the thin sheet Pn is completed, the cutting edge of the rotary blade 46*b* moves away from the cutting edge of the fixed blade 32*b*, so as to release the blocking of the leading end Pse of the next sheet Ps. As illustrated in FIG. 10, at the moment when the downward deflection of the part of the next sheet Ps upstream of the cutting position CP in the conveyance direction is released, the next sheet Ps tends to be restored to an undeflected normal or original shape by the restoring force thereof, which directs the next sheet leading end Pse toward the fixed blade 32*b* above the conveyance path 3Y. Accordingly, the sheet cutting unit 6 prevents the leading end Pse of the next sheet Ps from entering below the rotary blade 46*b*.

That is, the sheet cutting unit 6 regulates the direction of the deflection of the part of the thin sheet Pn upstream of the cutting position CP in the conveyance direction such that the part of the thin sheet Pn is deflected toward the rotary blade 46*b* side beyond the conveyance path 3Y. With this, due to the restoring force of the next sheet Ps that is deflected toward the rotary blade 46*b* side beyond the conveyance path 3Y, the next sheet Ps is restored to the original state (undeflected state), which directs the traveling direction of the next sheet leading end Pse toward the fixed blade 32*b* side above the conveyance path 3Y, to prevent the leading end Pse of the next sheet Ps from getting into under the rotary blade 46*b*.

Figure 11:
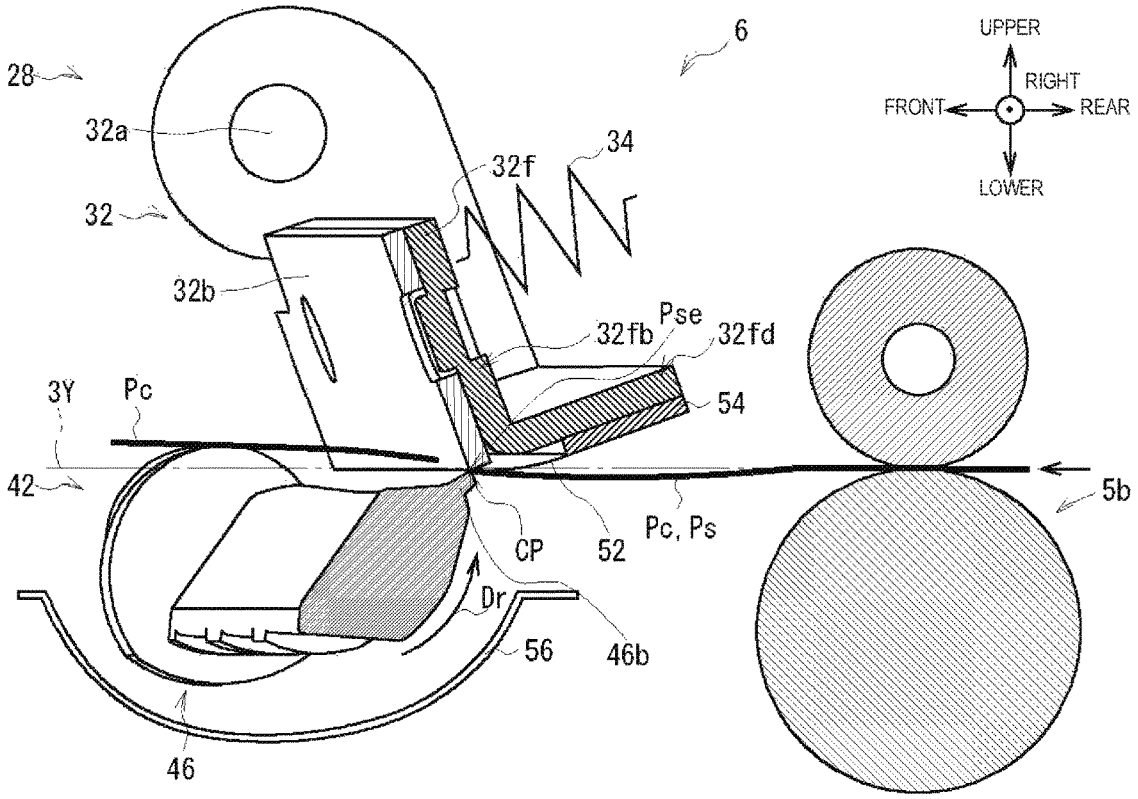
FIG. 11 is a diagram illustrating a cross-sectional view taken along line A-A in FIG. 3, illustrating a state in which a thick sheet is being conveyed according to one or more embodiments.

FIG. 11 illustrate a state upon cutting a cardboard Pc or a thick sheet Pc thicker than the thin sheet Pn. When the thick sheet Pc comes in contact with the lower end portion of the guide member 52, the end of the guide member 52 that is contact with the thick sheet Pc is deflected toward the fixed blade 32*b* side above the conveyance path 3Y to step back upwardly from the passage of the thick sheet Pc along the conveyance path 3Y, because the guide member 52 is the flexible and elastically deformable thin film. Further, the thick sheet Pc is less likely to be deformed than the thin sheet Pn and thus the next sheet leading end Pse thereof is less likely to be bent down than the thin sheet. Thus, even if the thick sheet Pc is scarcely deflected downward by the guide member 52, it is less likely that the leading end Pse of the next sheet Ps gets into under the rotary blade 46*b*.

7. Advantages

As described above, the sheet cutting unit 6 includes the guide member 52 fixed to the part of the frame lower end portion 32*fd* of the fixed blade part frame 32*f* upstream of the cutting position CP in the conveyance direction such that the lower end portion of the guide member 52 is projected downward further than the lower end portion of the fixed blade 32*b*. Thus, when the sheet cutting unit 6 cuts the thin sheet Pn, the sheet cutting unit 6 can bias the part of the thin sheet Pn upstream of the cutting position CP in the conveyance direction to be deflected toward the rotary blade 46*b* side while conveying the thin sheet Pn. Accordingly, after cutting the thin sheet Pn, the sheet cutting unit 6 can lead the next sheet leading end Pse of the next sheet Ps to proceed toward the fixed blade 32*b* side, by using the restoring force of the thin sheet Pn to resolve the deflection of the thin sheet that is deflected toward the rotary blade 46*b* side. Accordingly, upon cutting the thin sheet Pn, the sheet cutting unit 6 leads the next sheet leading end Pse of the next sheet Ps toward the rotary blade 46*b* side, and thus prevents the next sheet leading end Pse of the next sheet Ps from getting into under the rotary blade 46*b* so as to prevent jamming of the next sheet Ps.

Further in the sheet cutting unit 6, the guide member 52 is fixed to the fixed blade part frame 32*f*. That is, the guide member 52 is moved together with the fixed blade part 32. Accordingly, compared to a case where the guide member 52 is not fixed to the fixed blade part 32, the sheet cutting unit 6 can prevent a complexed structure and maintain an accuracy of the relative position of the end of the guide member 52 with respect to the cutting position CP, so as to stabilize the guidance of the passage of the sheet.

Note that in a case where a plurality of types of sheets is used in the image formation apparatus 1, the plurality of types of sheets may have different widths in the conveyance width direction. In such a case, if the sheets are conveyed in such a manner that the central portion of the sheets in the conveyance width direction are aligned with the central portion or the right end portion in the conveyance width direction in the conveyance path 3Y, the positions in the conveyance width direction that start to be cut at the cutting position CP are different from each other among the sheets having different widths.

In view of this, the guide member 52 is provided covering all the positions corresponding to the cutting start position Pcs side ends of all types of the sheets having different widths in the conveyance width direction, which are handled in the image formation apparatus 1. As a result, the sheet cutting unit 6 can prevent the leading ends Pse of various type of the sheets having different widths from bending down toward the rotary blade 46*b* side beyond the conveyance path 3Y.

Further, the guide member 52 is not continuously provided on the frame lower end portion 32*fd* in the entire width from the end thereof on the cutting start position Pcs side to the end thereof on the cutting end position Pce side. But the guide member 52 is provided in the range of only about the half of the frame lower end portion 32*fd* in the conveyance width direction on the cutting start position Pcs side. Note that the cut sheet starts to bend downward toward the rotary blade 46*b* from the cutting start position Pcs side but not from the cutting end position Pce side. Thus, even though the guide member 52 is not provided on the cutting end position Pce side, the sheet cutting unit 6 can lead, toward the fixed blade side, the part of the next sheet Ps on the cutting start position Pcs side, which starts to bend downward toward the rotary blade 46*b*. Accordingly, compared to a structure wherein the guide member 52 and/or the adhesive member 54 is continuously provided in the entire width from the cutting start position Pcs side to the cutting end position Pce side, the sheet cutting unit 6 can sufficiently prevent the next sheet Ps from bending downward toward the rotary blade 46*b* side beyond the conveyance path 3Y while reducing the number or the amount of components of the sheet cutting unit 6.

Further in the sheet cutting unit 6, the guide member 52 is continuously provided along the conveyance width direction. Thus, compared to a hypothetical structure wherein the guide member 52 is intermittently provided along the conveyance width direction, the sheet cutting unit 6 can prevent the leading end Pse of the next sheet Ps from getting stuck at the intermittent guide member 52, so as not to hinder the movement of the leading end Pse of the next sheet Ps toward the fixed blade 32*b* side.

in a case as a comparison example where the guide member 52 is formed of a member harder than a film which is hardly deformed even when coming in contact with the thick sheet Pc, if the thick sheet Pc has a stiffness property that lift up the fixed blade 32*b* against the bias force of the spring 34, the fixed blade 32*b* would be moved upwardly away from the rotary blade 46*b* due to the reactive force of the thick sheet Pc, which may reduce the contact pressure between the fixed blade 32*b* and the rotary blade 46*b*, to cause a defect or failure of cutting the sheet.

To the contrary, the sheet cutting unit 6 according to one or more embodiments described above includes the guide member 52 formed of the thin film having elastically deformable and flexible characteristic. Thus, when cutting the thick sheet Pc having the high stiffness, the end of the guide member 52 that is in contact with the thick sheet Pc is deflected upwardly toward the fixed blade 32*b* side to get away from the passage of the thick sheet Pc along the conveyance path 3Y. With this, even when conveying and cutting the thick sheet PC having the high stiffness, the sheet cutting unit 6 can prevent the fixed blade 32*b* from moving upwardly away from the rotary blade 46*b*, and thus can prevent the contact pressure between the fixed blade 32*b* and the rotary blade 46*b* from being reduced, to prevent a defect or failure of cutting the sheet. Therefore, even though the sheet cutting unit 6 is configured such that the guide member 52 is fixed to the fixed blade 32*b* and thus moved together with the fixed blade 32*b*, the sheet cutting unit 6 can absorb the reactive force of the thick sheet Pc by means of the flexible guide member 52 and thus stabilize the cutting property thereof for the sheets having various thicknesses.

Further, in the sheet cutting unit 6, the guide member 52 is formed of the thin film. Thus, the sheet cutting unit 6 can minimize resistance that the sheet receives from the guide member 52 that is in slide contact with the sheet and thus prevent an abnormal conveyance of the sheet due to the contact between the guide member 52 and the sheet.

As described above, the sheet cutting unit 6 includes the fixed blade unit 28 provided on one side (for example, the upper side) with respect to the sheet conveyance path 3Y, serving as the medium conveyance path, in the thickness direction of the sheet P which is orthogonal to the sheet surface, and the rotary blade unit 42 provided on the other side (for example, the lower side) with respect to the sheet conveyance path 3Y and configured to rotate in the rotation direction Dr to pass by the cutting edge of the fixed blade 32*b* of the fixed blade unit 28, so as to cut at the sheet cutting position CP the sheet P being conveyed. The sheet cutting unit 6 further includes the guide member 52 provided upstream of the cutting position CP in the conveyance direction and configured to bias the sheet toward the rotary blade unit 42.

With the above described configurations, after the sheet Pn is cut, the leading end Pse of the next sheet Ps is moved toward the fixed blade 32*b* side due to the restoring force of the sheet Ps to resolve the deflection of the sheet Ps deflected toward the rotary blade 46*b*.

Figure 12:
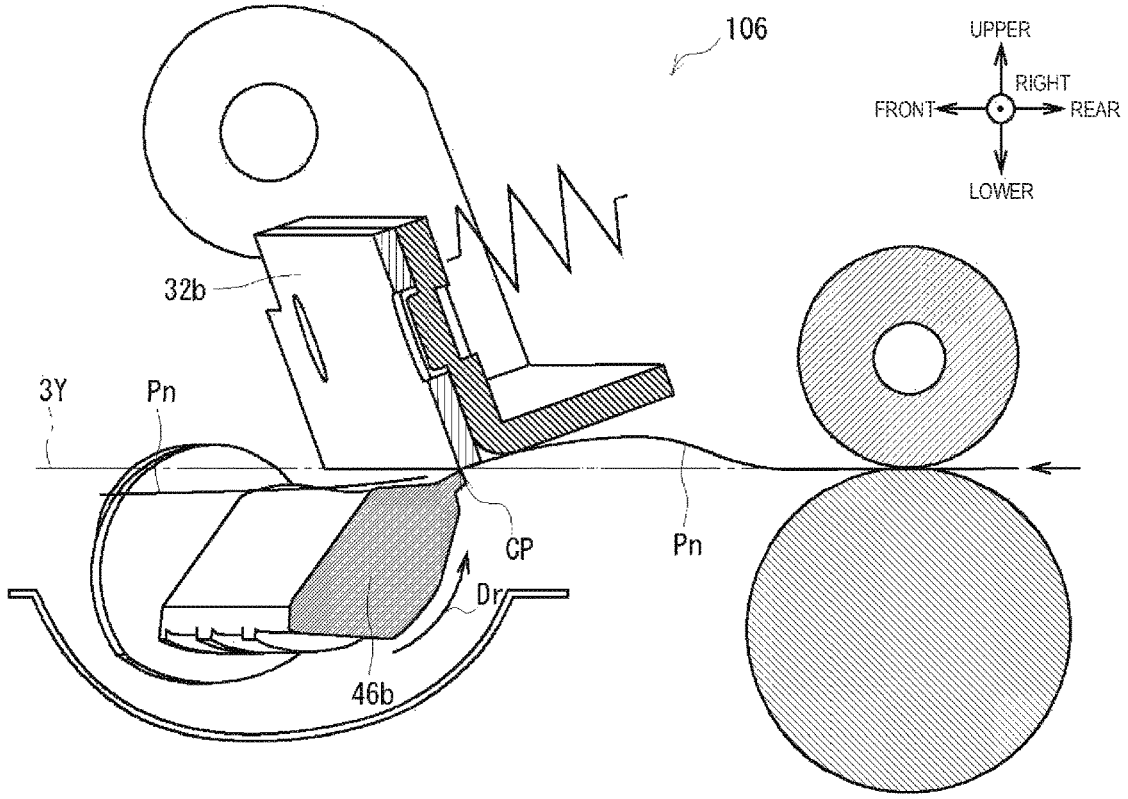
FIG. 12 is a diagram illustrating a cross-sectional view of a sheet cutting unit according to a related art, illustrating a state (1) where a thin sheet is being conveyed.
Figure 13:
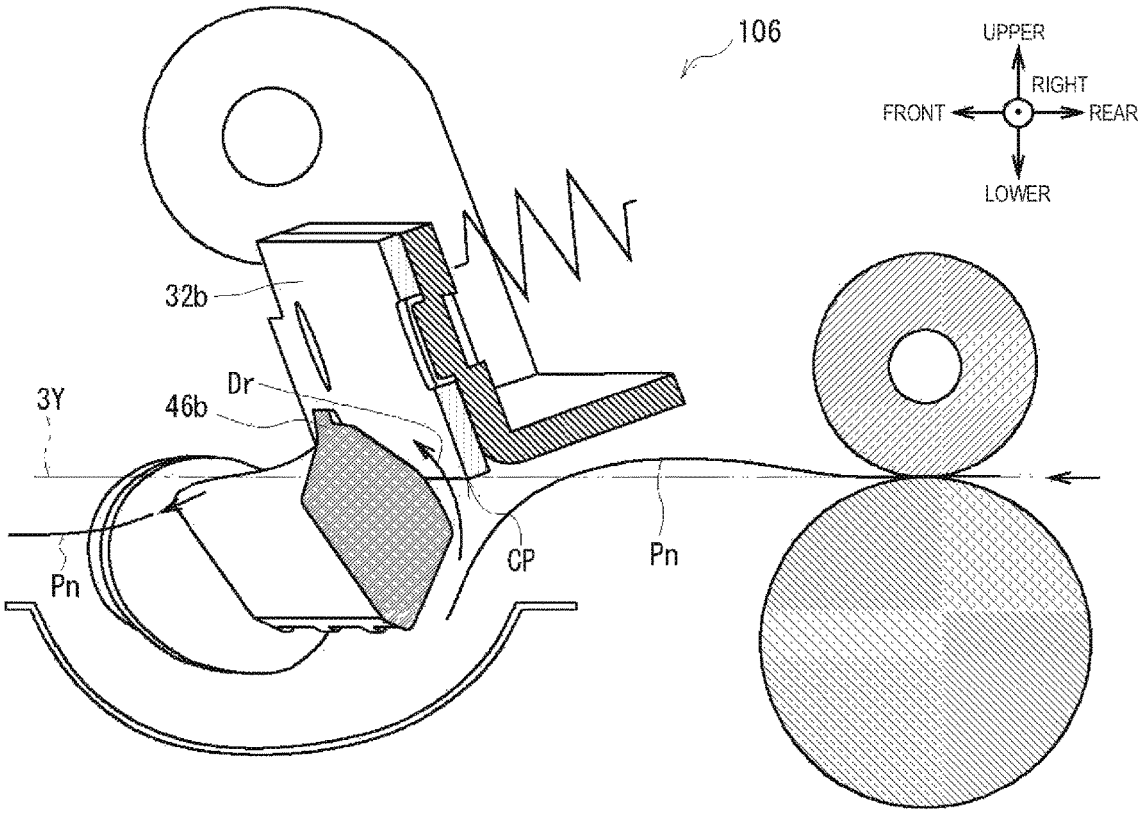
FIG. 13 is a diagram illustrating a cross-sectional view of the sheet cutting unit according to the related art, illustrating a state (2) where the thin sheet is being conveyed.

FIG. 12 illustrates a sheet cutting unit 106 of a medium cutting device according to a related art. The sheet cutting unit 106 includes a fixed blade 32*b* positioned above the conveyance path 3Y and a rotary blade 46*b* positioned below the conveyance path 3Y. The rotary blade 46*b* is rotated in the rotation direction Dr, while the sheet Pn is conveyed by the conveyance roller pair 5*b*, to cut the sheet P. When the sheet cutting unit 106 cuts the sheet P (particularly a thin sheet Pn) while conveying the sheet P, a portion of the sheet P upstream than the cutting position CP may be bent upward such that the leading end of sheet P is oriented downward. When the bent of the sheet P is released at the end of cutting of the sheet P, the leading end of the sheet P may move downward below the lower side of the rotary blade 46*b* due to a restoring force of the sheet P as illustrated in FIG. 13. This may cause the jamming of the sheet P.

In contrast, the sheet cutting unit 6 according to one or more embodiments described above can lead the leading end Pse of the next sheet Ps toward the fixed blade 32*b* side using the restoring force of the sheet Ps to resolve the deflection of the sheet Ps deflected toward the rotary blade 46*b*. Thus, jamming of the sheet P can be prevented.

8. Other Embodiments

In one or more embodiments described above, the guide member 52 is fixed to the fixed blade part 32. However, the invention is not limited to this. For example, the guide member 52 may not be fixed to the fixed blade part 32, even if the structure thereof may be complexed and the accuracy of the position thereof relative to the cutting position CP may be hard to be maintained. Further, the sheet cutting unit 6 may be configured such that the guide member 52 is moved together with the fixed blade part 32 even though the guide member 52 is not fixed to the fixed blade part 32.

In one or more embodiments described above, the guide member 52 is continuously provided on the lower surface of the frame lower end portion 32*fd* from the cutting start position Pcs side end to about the central portion in the conveyance width direction. However, the invention is not limited to this. For example, in an embodiment, the guide member 52 may be provided on the lower surface of the frame lower end portion 32*fd* from the cutting start position Pcs side end to a position further than the central portion in the conveyance width direction toward the cutting end position Pce side. Further, in an embodiment, the guide member 52 may be provided on the lower surface of the frame lower end portion 32*fd* from the cutting start position Pcs side end to the cutting end position Pce side end in the conveyance width direction. Further, in an embodiment, if sheets having only a single size are handled in the image formation apparatus 1, the length of the guide member 52 in the conveyance width direction may be shortened so as to only cover an end portion of the sheet on the cutting start position Pcs side.

Further, in one or more embodiments described above, the guide member 52 is continuously provided along the conveyance width direction. However, the invention is not limited to this. For example, the guide member 52 may include plural guide members 52 intermittently provided along the conveyance width direction.

In one or more embodiments described above, the guide member 52 is formed of a film. However, the invention is not limited to this. For example, in an embodiment, the guide member 52 may be formed of a member or material other than a film as long as the guide member 52 can be deformed to get away from the passage of the sheet when the sheet has a high stiffness. Further, in a case where the sheet cutting unit 6 cuts only a thin sheet Pn and does not cut a thick sheet Pc, in a case where a thick sheet Pc has a lower stiffness and thus does not lift up the fixed blade 32*b* against the bias force of the spring 34, or in a case where the guide member 52 is not moved together with the fixed blade 32*b*, or in other cases, the guide member 52 may be formed of a member or material whose stiffness is harder than a film and hardly deformed when coming in contact with the thick sheet Pc.

Further in one or more embodiments described above, the guide member 52 is fixed to the fixed blade part 32 with the adhesive member 54 formed of the double-sided adhesive tape. However, the invention is not limited to this. For example, the guide member 52 may be fixed to the fixed blade part 32 with an adhesive member formed of one or more of various materials such as adhesive agent, or the like, other than the double-sided adhesive tape.

Furthermore, in one or more embodiments described above, the fixed blade unit 28 and the rotary blade unit 42 are respectively arranged on the upper side and the lower side of the conveyance path 3Y in the sheet cutting unit 6. However, the invention is not limited to this. For example, a sheet cutting unit may include a rotary blade unit and a fixed blade unit provided on the upper side and the lower side of the conveyance path 3Y, respectively, or a sheet cutting unit may include a rotary blade unit and a fixed blade unit provide respectively on a front side and a rear side of a conveyance path extending along the vertical direction Further, in one or more embodiments described above, the sheet cutting unit 6 that cuts the sheet that is unwind form the rolled sheet. However, the invention is not limited to this, and may be applied to a sheet cutting unit that cuts a cut sheet or the like.

Further, in one or more embodiments described above, the sheet cutting unit 6 is provided upstream of the image formation section 8 in the conveyance direction. However, the invention is not limited to this. For example, the sheet cutting unit 6 may be provided downstream of the image formation section 8 in the conveyance direction.

Further, in one or more embodiments described above, the direct transfer type image formation apparatus 1 has been described. However, the invention is not limited to this, and may be applied to various types of image formation apparatuses or the like such as an intermediate transfer type image formation apparatus in which a toner image primarily transferred onto an intermediate transfer belt is secondarily transferred onto a sheet serving as a medium.

Further, in one or more embodiments described above, the image formation apparatus 1 uses the three process units 9. However, the invention is not limited to this, and may be applied to a single-color image formation apparatus using one process unit, or an image formation apparatus using any number of process units of two or four or more.

Further, in one or more embodiments described above, the sheet cutting unit 6 is provided in the image formation apparatus 1 formed of the electrophotographic printer. However, the invention is not limited to this, and may also be applied to a sheet cutting unit provided in any other image formation apparatuses, such as an MFP (Multi-Function Printer), a copying machine, an automatic document reading device, or the like.

Furthermore, in one or more embodiments described above, the sheet cutting unit 6 as the medium cutting device is configured to include the fixed blade unit 28 as a fixed blade, the rotary blade unit 42 as a rotary blade, and the guide member 52 as a guide member. However, the invention is not limited to this. For example, a medium cutting device may be configured to include fixed and rotary blades and a guide member having various configurations.

The invention can also be used in various devices for cutting sheet.

The invention includes other embodiments in addition to the above-described embodiments and modifications without departing from the spirit of the invention. The embodiments and modifications are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

The invention claimed is:

1. A medium cutting device comprising:

a fixed blade provided on one side with respect to a conveyance path in which a medium is conveyed in a thickness direction of the medium orthogonal to a surface of the medium and including a cutting edge thereof;

a rotary blade provided on an other side with respect to the conveyance path in the thickness direction, and including a cutting edge thereof, wherein the rotary blade is configured to be rotated in a rotation direction so that the cutting edge of the rotary blade passes by the cutting edge of the fixed blade to cut at a cutting position the medium being conveyed; and a guide member provided upstream of the cutting position in a conveyance direction of the medium and configured to bias the medium toward the rotary blade side, wherein the guide member is projected toward the rotary blade side beyond an end of the fixed blade on a side of the conveyance path, and the guide member is projected toward the rotary blade side beyond an imaginary straight line extending from a sandwich portion between a pair of conveyance members to the cutting position, the pair of the conveyance members being provided upstream of the fixed blade and the rotary blade in the conveyance path and configured to convey the medium toward the cutting position along the conveyance path.

2. The medium cutting device according to claim 1, wherein the guide member is configured to move together with the fixed blade.

3. The medium cutting device according to claim 2, wherein the guide member is fixed to the fixed blade.

4. The medium cutting device according to claim 1, wherein the guide member is provided at least on a side of a cutting start position in a conveyance width direction orthogonal to both the thickness direction and the conveyance direction, wherein the cutting start position is a position where the medium starts to be cut.

5. The medium cutting device according to claim 4, wherein the guide member extends to cover all of positions corresponding to ends of a plurality types of media having different widths on a side of the cutting start position in the conveyance width direction, wherein each of the media can be conveyed in the medium cutting device.

6. The medium cutting device according to claim 4, wherein the guide member is continuously provided along the conveyance width direction.

7. The medium cutting device according to claim 1, wherein the guide member comprises a flexible resilient member.

8. The medium cutting device according to claim 7, wherein the guide member is deformed according to a stiffness of the medium in contact with the guide member.

9. The medium cutting device according to claim 8, wherein the fixed blade is biased toward the rotary blade with a predetermined bias force, the guide member is deformed toward the fixed blade side, when coming in contact with the medium having the stiffness that moves the fixed blade away from the rotary blade by a force larger than the predetermined bias force.

10. The medium cutting device according to claim 9, wherein the guide member is formed of a film.

11. The medium cutting device according to claim 1, wherein the fixed blade is provided above the conveyance path and the rotary blade is provided below the conveyance path.

12. The medium cutting device according to claim 1, further comprising a frame to which the fixed blade is fixed, wherein the guide member is fixed to a lower end portion of the frame, the guide member is provided at least on a side of a cutting start position in a conveyance width direction orthogonal to both the thickness direction and the conveyance direction, wherein the cutting start position is a position where the medium starts to be cut, and the guide member has a length in the conveyance width direction less than a half of a length of the lower end portion of the frame in the conveyance width direction.

13. An image formation apparatus comprising the medium cutting device according to claim 1.

14. An image formation apparatus comprising:

the medium cutting device according to claim 1 configured to cut the medium and feed the cut medium along the conveyance path; and an image formation section provided downstream of the medium cutting device in the conveyance path and configured to form an image on the cut medium fed from the medium cutting device along the conveyance path.

* * * * *